US011602866B2

(12) United States Patent
Chatzigrigoriou et al.

(10) Patent No.: US 11,602,866 B2
(45) Date of Patent: Mar. 14, 2023

(54) MULTI-BLADE SHAVING RAZOR

(71) Applicant: BIC VIOLEX S.A., Anoixi (GR)

(72) Inventors: Nikos Chatzigrigoriou, Athens (GR); Giorgos Georgakis, Athens (GR); Thanasis Karagiannis, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 246 days.

(21) Appl. No.: 15/734,278

(22) PCT Filed: Jun. 13, 2019

(86) PCT No.: PCT/EP2019/065544
§ 371 (c)(1),
(2) Date: Dec. 2, 2020

(87) PCT Pub. No.: WO2019/238844
PCT Pub. Date: Dec. 19, 2019

(65) Prior Publication Data

US 2021/0213630 A1 Jul. 15, 2021

(30) Foreign Application Priority Data

Jun. 13, 2018 (EP) ..... 18177555

(51) Int. Cl.
*B26B 21/22* (2006.01)
*B26B 21/40* (2006.01)
*B26B 21/52* (2006.01)

(52) U.S. Cl.
CPC ..... *B26B 21/227* (2013.01); *B26B 21/4018* (2013.01); *B26B 21/4025* (2013.01);
(Continued)

(58) Field of Classification Search
None
See application file for complete search history.

(56) References Cited

U.S. PATENT DOCUMENTS 4,378,634 A * 4/1983 Jacobson ..... B26B 21/4018 30/47
4,586,255 A * 5/1986 Jacobson ..... B26B 21/4068 30/41

(Continued)

FOREIGN PATENT DOCUMENTS

CA 2 300 254 A1 * 10/2000
EP 3072646 A1 9/2016

(Continued)

OTHER PUBLICATIONS

International Search Report and Written Opinion in International Application No. PCT/EP2019/065544, dated Sep. 12, 2019 (13 pages).

*Primary Examiner* — Hwei-Siu C Payer
(74) *Attorney, Agent, or Firm* — Bookoff McAndrews, PLLC

(57) ABSTRACT

A razor head for shaving is provided. The razor head includes a plurality of blades movably mounted within a support and a plurality of resilient members, wherein each blades of the plurality of blades is biased toward a shaving plane, at least in part, by at least one of the plurality of resilient members, and wherein at least one of the plurality of blades is biased toward the shaving plane with a first force that is greater than a second force biasing another of the plurality of blades toward the shaving plane.

19 Claims, 4 Drawing Sheets

(52) U.S. Cl.
CPC ..... *B26B 21/4031* (2013.01); *B26B 21/4068* (2013.01); *B26B 21/521* (2013.01)

(56) References Cited

U.S. PATENT DOCUMENTS 5,224,267 A * 7/1993 Simms ..... B26B 21/4068 30/527
5,313,706 A 5/1994 Motta et al.
5,402,574 A * 4/1995 Milner ..... B26B 21/522 30/41.5
5,426,851 A * 6/1995 Gilder ..... B26B 21/4012 30/34.2
5,546,660 A * 8/1996 Burout ..... B26B 21/227 30/48
6,295,734 B1 10/2001 Gilder et al.
7,448,135 B2 11/2008 Zhuk et al.
7,703,361 B2 * 4/2010 Johnson ..... B26B 21/44 83/13
9,844,887 B2 12/2017 Griffin et al.
11,345,055 B2 * 5/2022 Long ..... B26B 21/521
2004/0078986 A1 * 4/2004 Guimont ..... B26B 21/44 30/538
2010/0175265 A1 * 7/2010 Bozikis ..... B26B 21/227 30/526
2016/0279817 A1 * 9/2016 Washington ..... B26B 21/227
2018/0071931 A1 * 3/2018 Walker, Jr. ..... B26B 21/4068
2021/0213630 A1 * 7/2021 Chatzigrigoriou ..... B26B 21/4025

FOREIGN PATENT DOCUMENTS

WO 9610472 A1 4/1996
WO 2007147420 A1 12/2007

* cited by examiner

MULTI-BLADE SHAVING RAZOR

This application is a National Stage Application of International Application No. PCT/EP2019/065544, filed on Jun. 13, 2019, now published as WO/2019/238844 and which claims priority to European Patent Application No. 18177555.2, filed Jun. 13, 2018, entitled "MULTI-BLADE SHAVING RAZOR".

FIELD OF THE DISCLOSURE

The present disclosure is related to mechanical shaving razors having a plurality of movable blades, and more particularly to such a razor head incorporating a plurality of cantilevered springs regulating motion of the plurality of movable blades.

BACKGROUND OF THE DISCLOSURE

A shaving razor head typically includes one or more blades mounted within a housing including a guard bar (at a base of the cartridge) and a cap at a top of the cartridge. The guard bar and cap may include various implements such as skin lubricants, beard softeners, hair stretchers, etc., with a goal of improving a shaving experience for a user.

During shaving, pressure applied by a user against the skin is typically exerted at a head to handle pivot axis point. When shaving is performed in this way with shaving heads designed to have a pivot axis at the shaving plane (as defined by two or more blade edges) or slightly behind the shaving plane, shaving pressure may be primarily applied on the blade edges that are directly over the pivot axis point. This may lead to skin irritation during shaving and to higher friction forces during hair cutting, as the blade edges become too aggressive due to the extra pressure applied on them, and a shaving experience may become unpleasant for the user.

Conventional shaving razor heads have attempted to address this problem using blades with negative exposure or with progressive exposure so as to prevent skin irritation.

Alternatively, or in addition, movable blades have been used so as to compensate the extra pressure during shaving as well as to provide a smoother shave. Such movable blade heads include springs having a uniform and constant force supporting each blade, the spring force being uniform across all razor blades of the razor head, regardless of the blade position with respect to the pivot axis. Movable blade cartridges such as these present additional complications, for example, where a negative or progressive geometry is not possible, and may still result in dragging and/or lack of fluidity during shaving due to force distribution.

U.S. Pat. No. 6,295,734 discloses a safety razor blade unit with a guard, a cap and three parallel blades mounted between the guard and cap, at least one of the blades, guard and cap being movable from an at rest (non-shaving) position to modify a blade exposure dimension to attain a target blade geometry, at which shaving is initiated. The exposure of the first blade is not greater than zero and the exposure of the third blade is not less than zero. At least one of the cap and guard can be movable against the force of a spring from an at rest position in which all the blades between the guard and cap have their cutting edges disposed below a plane tangential to the skin contacting surfaces of the guard and cap. The blades can be independently sprung or carried for movement in unison on a carrier pivotally mounted in a frame of the blade unit. This can result in a modified geometry.

U.S. Pat. No. 9,844,887 discloses replaceable shaving assemblies including a blade unit, an interface element configured to removably connect the blade unit to a handle, on which the blade unit is pivotably mounted, and an elastomeric element disposed between the blade unit and interface element. The elastomeric element is designed such that its geometry provides an applied load as assembled that is sufficient to overcome the friction of the system at rest (pretensioned load).

U.S. Pat. No. 7,448,135 discloses multi-blade razors having blades with differing properties. A razor is provided that includes a safety razor blade unit comprising a guard, a cap, and first, second and third blades with parallel sharpened edges located between the guard and cap with the first blade closest to the cap, the third blade furthest from the cap, and the second blade disposed between the first and third blades, the blades having first, second and third tip radii, respectively, at least two of the three blades having different tip radii, and at least two of the blades having different coefficients of friction.

SUMMARY OF THE DISCLOSURE

It has been found that it remains desirable to further improve the shaving experience and to better manage the shaving forces applied during shaving.

Embodiments of the present disclosure therefore provide a razor head for shaving, including a plurality of blades movably mounted within a support and a plurality of resilient members, wherein each blade of the plurality of blades is biased toward a shaving plane, at least in part, by at least one of the plurality of resilient members, and wherein at least one of the plurality of blades is biased toward the shaving plane with a first force that is greater than a second force biasing another of the plurality of blades toward the shaving plane.

This configuration provides a razor head with "adjusted spring force" movable blades. A razor guard according to embodiments of the present disclosure may include cantilever springs supporting the movable blades, the springs being designed and manufactured so as to provide one or more softer springs for certain movable blades (e.g., those that are located between the guard bar and the pivot axis) and one or more harder springs for the remainder of the movable blades (e.g., those blades between the pivot axis and the cap). By adjusting placement of the stiffer and softer blades, a modified shaving geometry and experience can be provided, and the shaving forces may be more evenly distributed among the blades, rather than concentrated at one or more specific blades.

In addition, "softer" cantilever springs allow the blade edges to retract to compensate for the pressure applied by the user during shaving on the blades, thus leading to less irritation. Less dragging forces during shaving are also achieved by blades that precede the pivot axis point, thereby allowing a more fluid shave. At least one of the plurality of resilient members may have a stiffness different than that of another one of the plurality of resilient members.

At least one of the plurality of blades may be supported by a greater number of resilient members than another of the plurality of blades.

According to some embodiments, for example, a razor head having a constant positive exposure, a first stiffness of a first resilient member located nearest a guard bar of the razor head may be lower than a second stiffness of a second resilient member located nearest to a cap of the razor head.

Alternatively, some embodiments, for example, a razor head having a constant negative exposure, may present a first stiffness of a first resilient member located nearest a guard bar of the razor head may be higher than a second stiffness of a second resilient member located nearest to a cap of the razor head. In other words, depending on a desired blade exposure and shaving experience, it may be possible to adapt stiffness of the resilient members to provide the intended effect.

A third resilient member positioned between the first resilient member and the second resilient member along an axis between the cap and guard, may have a third stiffness which is different as compared to the first stiffness and the second stiffness.

The plurality of blades may include at least two blades, specifically at least three blades, more specifically, at least four blades, for example, five blades.

The razor head may include a handle connection point at which a handle for the shaving cartridge is attached, wherein each of the plurality of resilient members located between the guard bar and an axis running longitudinally along the razor head through the handle connection point, has a stiffness lower than a stiffness of each of the plurality of resilient members positioned between the axis and the cap.

The resilient members may comprise cantilevered springs having a proximal end and a distal end, the distal end maintaining contact with its corresponding blade to cause the biasing.

A first stiffness for a first resilient member may be set such that a spring force for the first resilient member ranges between 10-15 grams at 0.5 mm of displacement and a second stiffness for a second resilient member may be set such that a spring force for the second resilient member ranges between 25-35 grams at 0.5 mm of displacement, the displacement being measured from a free, unstressed position of a distal end of each respective resilient member.

In addition, a spring constant (k) for a first resilient member may range between 20-30 gram force/mm and a second constant for a second resilient member may be set such that it ranges between 50-60 gram force/mm.

A modulus of elasticity of a material comprising the resilient members may range between 1500 and 3000 MPa, specifically between 1800 and 2400, and more specifically between 2000 and 2200, and even more specifically, approximately 2100.

The plurality of resilient members and a housing comprising the cap and the guard bar of the razor head may be unitarily molded, specifically injection molded.

The resilient members may comprise a material selected from, Polystyrene, High Impact Polystyrene, Polypropylene, Polyethylene, blends of Polyphenylene Oxide with Polystyrene, blends of Polyphenylene Ether with Polystyrene, Acrylonitrile Butadiene Styrene Copolymer (ABS).

A first cross sectional area of a first resilient member taken along a plane perpendicular to the longitudinal axis of the razor head and the shaving plane may differ from a second cross sectional area of a second resilient member taken along the same plane.

A first cross sectional area of a first resilient member taken along a plane perpendicular to the longitudinal axis of the razor head and the shaving plane may vary along the longitudinal axis, specifically decreasing in area from a proximal end to a distal end thereof.

The second resilient member may have a greater thickness at its proximal end, than the first resilient member at its respective proximal end.

The second resilient member may have a greater thickness along its entire length, than the first resilient member at any point along its length.

A difference between a thickness of the first resilient member and the second resilient member at any common point along a longitudinal axis thereof, may be between approximately 10 and 50 percent.

At least one of the resilient members may comprise a material different than that of another of the resilient members.

The housing and the resilient members may be formed via a multi-stage injection molding process or by assembly of first and second parts, where the first part forms softer resilient members and the second part forms harder resilient members.

According to some embodiments of the disclosure a razor head having one or more additional sets of resilient members, e.g., finger-like cantilever springs, providing additional biasing force on one or more of the blades. For example, the two blades closest to a guard bar of the razor head may have only the "conventional" resilient member configuration, i.e., one contact point with each of two cantilever springs. In that way, all "conventional" springs may have the same stiffness.

An additional set of resilient members may be provided for blades closest to the cap of the razor head. For example, one or more additional resilient members, e.g., two additional resilient members, may be provided for each blade, making a total of one contact point for each of four cantilever springs on each of these cutting elements.

By providing such additional resilient members, the force required to overcome biasing caused by the additional resilient elements (e.g., four instead of two) can be increased as compared to the cutting elements having only two resilient members performing the biasing.

It is intended that combinations of the above-described elements and those within the specification may be made, except where otherwise contradictory.

The accompanying drawings, which are incorporated in and constitute a part of this specification, illustrate embodiments of the disclosure and together with the description, serve to explain the principles thereof.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

Embodiments of the present disclosure provide a razor head with movable blades having an "adjusted spring force," i.e., wherein some blades of a plurality of blades are biased toward the shaving plane with a different force than other blades. Embodiments of the present disclosure introduce a razor head including springs, for example, cantilever springs, supporting movable blades, the springs being designed and manufactured so as to provide softer springs for some of the movable blades, for example, those located between the guard bar and the pivot axis between the handle and razor head, and stiffer springs, for example, for the remaining movable blades between the cap and the pivot axis.

Figure 1:
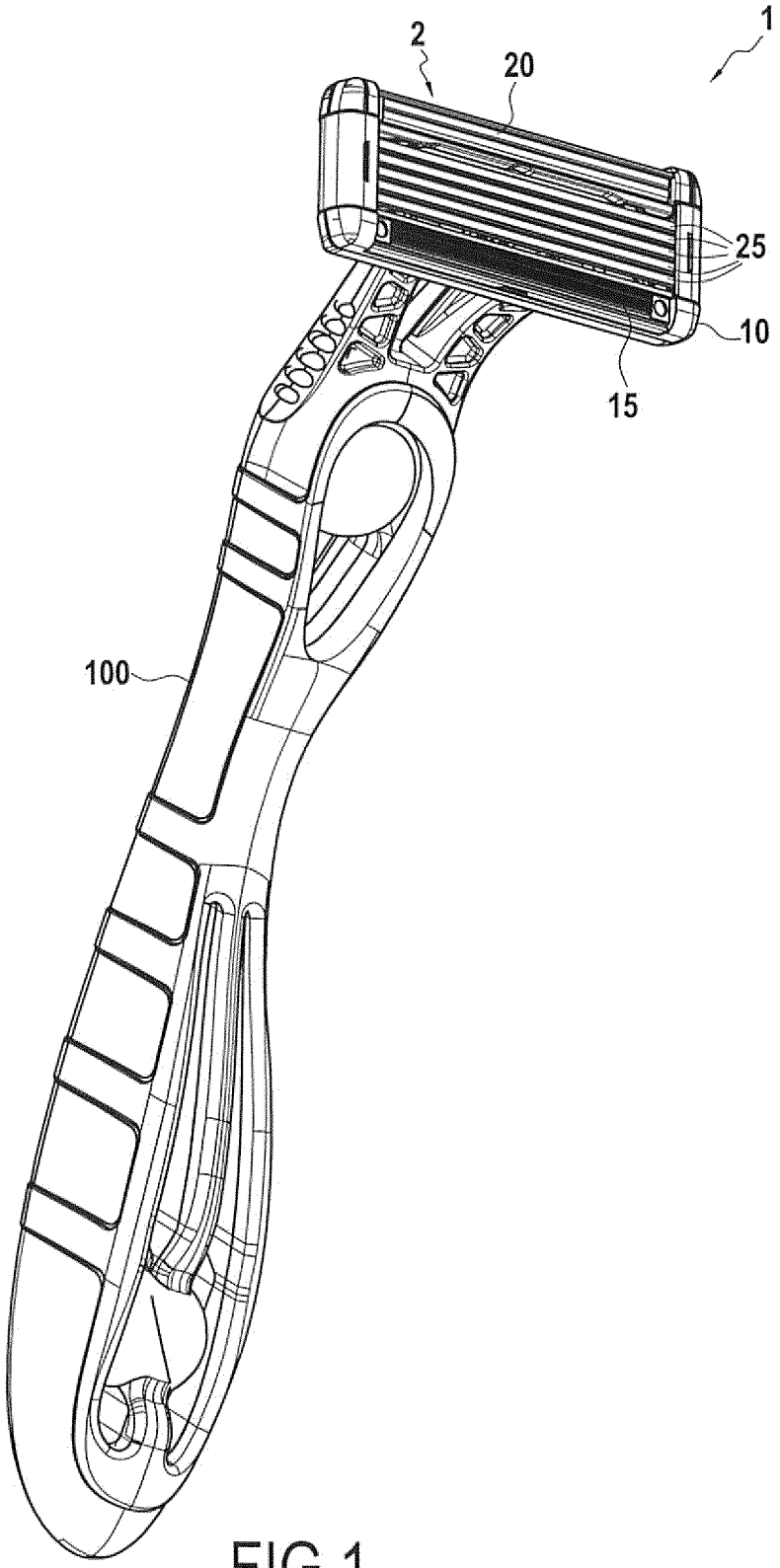
FIG. 1 shows an exemplary shaving device according to embodiments of the present disclosure.

FIG. 1 shows an exemplary shaving device 1 according to embodiments of the present disclosure. Such a shaving device may include a handle 100 and a razor head 2, among others. Handle 100 may be configured such that a user may grasp and 100 while operating the shaving device 1 while shaving, and may be ergonomically designed accordingly. One of skill in the art will recognize that handle 100 may take any desired shape and form, provided that handle 100 is configured to be either movably attached to razor head 2, and, in some examples, removable therefrom.

Razor head 2 may comprise a housing 10, comprising a cap 20 and a guard bar 15, among others, a plurality of cutting elements 25, and a plurality of resilient members 30-31.

Housing 10 of razor head 2 and its constituent parts may be fabricated from any suitable material, for example, a plastic, and more particularly a thermoplastic material. For example such materials may include high impact polystyrene (HIPS), Polypropylene (PP), a blend of Polystyrene with Polyphenelyne Oxide, and specifically acrylonitrile butadiene styrene (ABS) copolymer. Housing 10 may be configured to be house and support cutting elements 25 at a predetermined spacing. In this regard support cutting elements 25 will be discussed in greater detail below with respect to resilient members 30-31.

Cap 20 and guard bar 15 may be unitarily molded with housing 10, for example by injection molding, and may form portions of housing 10 configured to be at or near a surface of the shaving plane during operation of shaving device 1. In addition, cap 20 and guard bar 15 may include various elements known in the art such as, for example, lubricant strips, skin stretching devices, hair-raising devices, etc. Such elements may be affixed to guard bar 15 and/or cap 20 via adhesives or any other suitable method. In addition, guard bar 15 and/or cap 20 may include such features as heating and/or cooling devices, among others.

Cap 20 and guard bar 15 aid in defining a shaving plane of razor head 2. For purposes of the present disclosure the shaving plane is defined by a tangent line intersecting the front surfaces of the guard bar 15 of the housing 10 and the cap 20 of the housing 10. A front face of the guard bar 15 and cap 20 is that surface of each which is intended to contact the surface of the user to be shaved, regardless of the presence of intervening elements (e.g., lubricant strips, skin stretchers, etc.). In addition, the term "exposure" as used herein is intended to mean the perpendicular distance from the cutting edge of a cutting element 25 to the shaving plane. For a person skilled in the art the exposure is typically considered positive when the cutting edge is disposed above this tangent line and is considered negative when the cutting edge is positioned below this tangent line, in an at rest position.

Cutting elements 25 are configured to cut hair present on a surface to be shaved, and may be provided in any suitable number equal or greater than 2. For example, a cutting element 25 may comprise a razor blade, and a plurality of cutting elements 25 may comprise at least two blades, at least three blades, at least four blades, or even, for example, five blades or more.

Cutting elements 25 are movably mounted within housing 10 of razor head 2 such that cutting elements 25 may move toward and away from the shaving plane, as such shaving plane is defined above, and may be positioned and spaced so as to facilitate cutting of hair present at the shaving plane via motion of the razor cartridge 2 over the shaving plane.

Cutting elements 25 may comprise any suitable material which may be honed or otherwise sharpened to a fine edge suitable for cutting hair, the materials comprising for example, steel and alloys thereof.

Cutting elements are movably retained within housing 10 via any combination of the housing 10 itself, cap 20, guard bar 15, and resilient members 30-31, which will be discussed in greater detail below.

Further aspects of shaving blades comprised by cutting elements 25 are known in the art, and will not be further explained herein.

Figure 2:
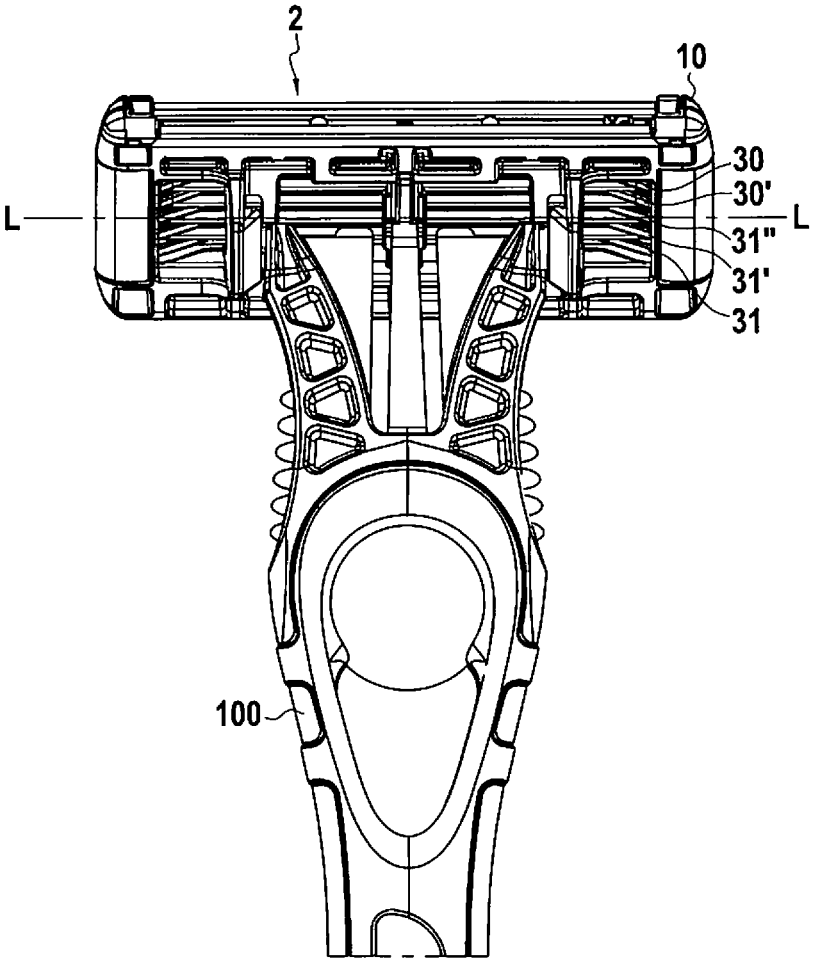
FIG. 2 shows a reverse view of a portion of the shaving device of FIG. 1.
Figure 3:
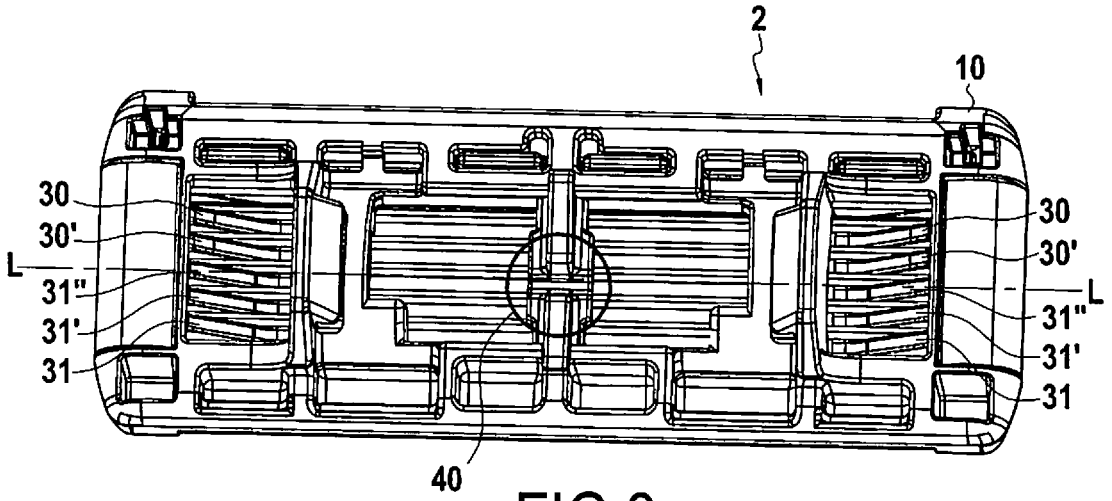
FIG. 3 shows a schematic representation of a reverse of a razor head for shaving according to embodiments of the present disclosure.

FIGS. 2 and 3 show a back portion of shaving device 1 and razor head 2 respectively, according to embodiments of the present disclosure. Razor head 2 may include a pivot point/connection point 40 at which razor head 2 and handle 100 may be connected. Razor head 2 may pivot in relation to an installed handle 100.

A pivot axis L may be defined by a longitudinal axis of razor head 2 which may pass through pivot point 40, although pivot axis L may be located in front of or behind pivot point 40. Razor head 2 may be provided with features to enable connection to handle 100 and pivoting of razor head 2 and one of ordinary skill in the art is familiar with such connective features.

Figure 5:
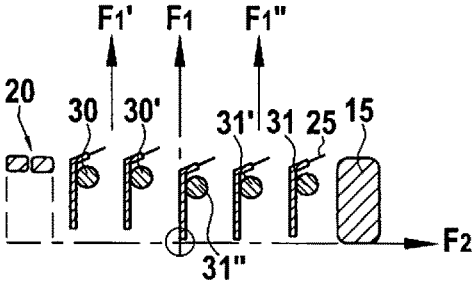
FIG. 5 shows a force distribution and exemplary shaving geometry when a shaving device of the present disclosure is operated by a user.

During shaving, the pressure applied by the user while holding handle 100, and pressing razor head 2 against the skin, shown as $F_1$ at FIG. 5, may be primarily exerted at the razor-head-to-handle pivot axis point 40. The razor head 2 is then passed along the surface to be shaved with a force shown as $F_2$ at FIG. 5. This pressure along with reactive forces from the surface to be shaved (and imperfections thereon) cause cutting elements 25 to move toward and away from the shaving plane within housing 10, and to act against biasing of resilient member 30-31.

As shown at FIGS. 2 and 3 a plurality of resilient members 30-31 (e.g., springs) are provided for biasing cutting elements 25, to enable cutting elements 25 to be applied to the surface to be shaved with an "adjusted force" $F_1'$ and $F_1''$ depending on characteristics of razor head 2 and resilient members 30-31 to be described.

As shown, resilient members may comprise springs 30-32, e.g., cantilever type springs with a proximal end located in connection with housing 10 and a distal end in contact with a portion of a respective cutting element 25.

Of course, cantilever type springs are just one non-limiting example of resilient members 30-32, and resilient members 30-32 may comprise any combination of springs selected from cantilever springs, coil springs, leaf springs, volute springs, etc.

In an at rest position of razor head 2, resilient members 30-32 provide support to cutting elements 25, while allowing motion of cutting elements 25 toward and away from the shaving plane within housing 10 when shaving device 1 is in use.

Resilient members 30-32 may be present in pairs, i.e., a pair of resilient members is implemented to support and bias a single cutting element 25. For example, a right-side resilient member 30-31 may be positioned at a first end of housing 10 with a left-side, substantially identical, resilient member 30-32 aligned with the right-side resilient member 31 along a longitudinal axis of razor head 2. A distal end of each of the right and left-side resilient members 30-32 may be in contact with a cutting element 25 to provide support for that cutting element 25 within housing 10.

Figure 6:
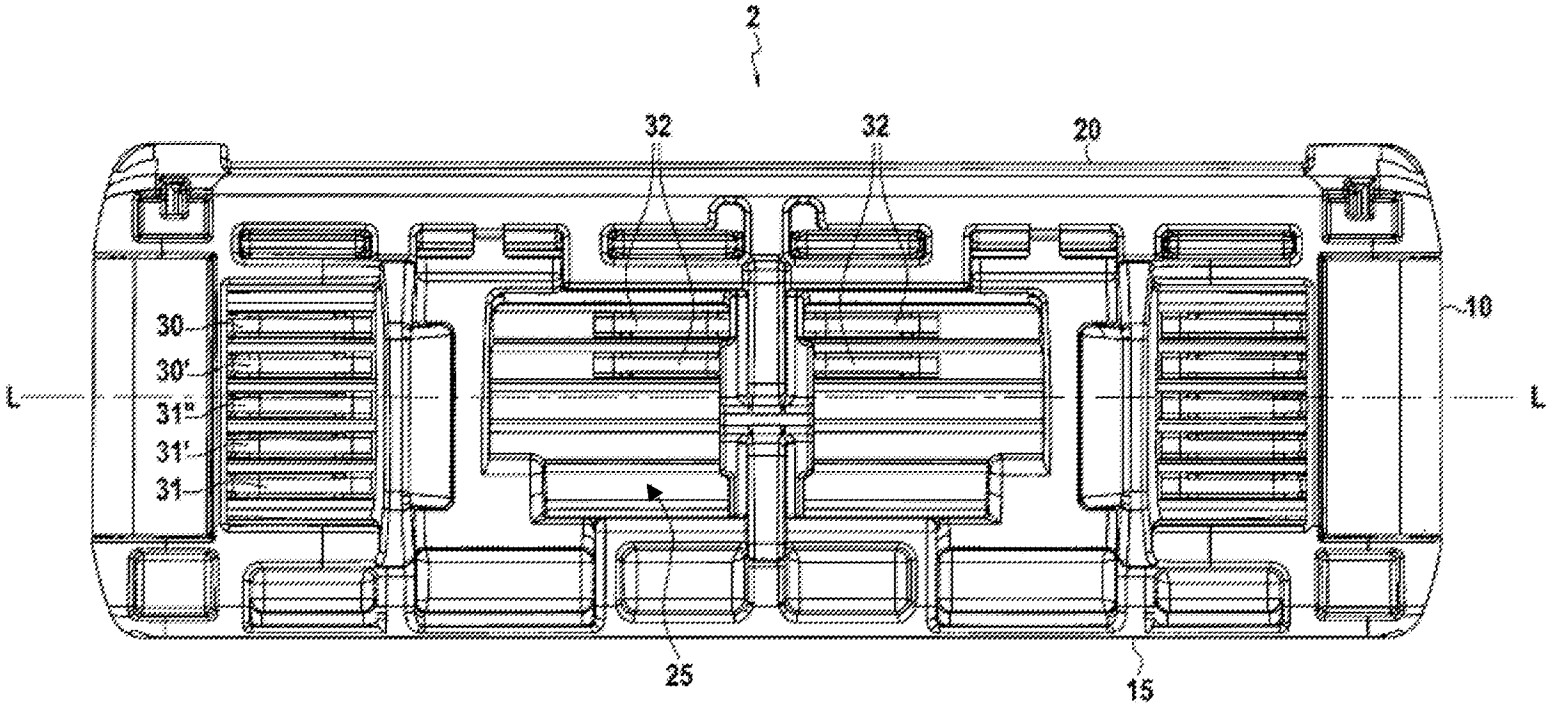
FIG. 6 shows a rear view of a razor head according to some exemplary embodiments of the disclosure.

Alternatively, and according to some embodiments, some cutting elements 25 may be provided with support and biasing from three or more resilient members (30; 31; 32), for example, four resilient members, while other cutting elements of the same razor head 2 may be provided with only 2 (i.e., one pair).

Where three or more resilient members 30; 31; 32 are provided, a first resilient member may extend from a first side of razor head 2, a second resilient member may extend from a second side of razor head 2, and one or more resilient members 32 may extend from a center support of razor head 2, as shown at FIG. 6.

Resilient members 30-32 are configured to bias cutting elements 25 toward the shaving plane, and according to embodiments of the present disclosure, a biasing force of at least one of the resilient members 30-31 is different than a biasing force of another of the resilient members 30-31. Specifically, each pair of right and left side resilient members exerts a substantially identical biasing force when razor head 2 is at rest, i.e., when no force $F_1$ is applied by a user toward the shaving plane.

It has been determined that biasing of cutting elements 25 by resilient members 30-32 using resilient members 30-32 having a different spring force based on their position within housing 10 can improve the shaving experience by modifying force distribution over the plurality of cutting elements 25 of the razor head 2. In other words, as shown at FIG. 5, instead of the force $F_1$ being distributed primarily over the cutting elements 25 located between the guard bar 15 and pivot axis L, the force $F_1$ may be more evenly distributed over all of the cutting elements 25 provided within the razor head 2 by providing softer (e.g., lower stiffness) resilient members supporting the cutting elements between guard bar 15 and pivot axis L.

According to embodiments of the present disclosure, a first resilient member 31 located nearest the guard bar 15 of the razor head is lower than a second stiffness of a second resilient member 30 located nearest to the cap 20 of the razor head. For example, a first stiffness for the first resilient member 31 may be set such that a spring force for the first resilient member 31 ranges between 10-15 grams at 0.5 mm of displacement.

A second stiffness for the second resilient member 30 may be set such that a spring force for the second resilient member 30 ranges between 25-35 grams at 0.5 mm of displacement.

The displacements described herein are measured from a free, unstressed position of a distal end of each respective resilient member 30-32 with its respective proximal end connected to housing 10.

First resilient members 31-31" may be interchangeably referred to as "softer resilient members" or "reduced stiffness members," while second resilient members 30-30' may be interchangeably referred to as "stiffer resilient members" and "increased stiffness members."

According to some embodiments all reduced stiffness members 31-31" between guard bar 15 and pivot axis L have substantially a same first stiffness, while stiffer resilient members 30 between cap 20 and pivot axis L have a same second stiffness different (and specifically greater) than the first stiffness. Alternatively, it may be possible to vary the stiffness of each resilient member over the entire shaving plane to obtain a desired geometry, examples of which are demonstrated below.

Varying of the stiffness/spring force of a resilient member 30-31 may be achieved in any suitable manner. Turning to FIGS. 4A-4D, exemplary configurations for achieving the varied stiffness/spring force of a resilient member 30-31 will be discussed.

Housing 10 of razor head 2 may be unitarily molded, for example, by injection molding, with cap 20, guard bar 15, and resilient members 30-31 molded in a single step from a single material. In such embodiments, the material used in a single injection molding step may be homogeneous, and may be comprised of the materials noted above with regard to housing 10.

In such embodiments, because a modulus of elasticity will be the same across all resilient members 30-31 (i.e., because the same material is used), for example, between about 2000 and 2200 MPa, to obtain a different stiffness/spring force, a thickness and/or cross-sectional area of one or more of the plurality of resilient members may differ from others of the resilient members 30-31.

Thickness differences for resilient members 30-31 may be achieved during the molding process, for example, based on a shape of the mold. Accordingly, where a substantially similar stiffness is used for softer resilient members 31-31", the softer resilient members may be thinner over at least a portion of their length than stiffer resilient members 30.

Such thickness differences may be uniform over an entire length of a resilient member 30-31, or may vary along a length thereof. Notably, thicknesses of resilient members 30 and 30' may remain identical, while each resilient member 31-31" may have a thickness that is reduced as compared with resilient member 30.

In addition, thicknesses may vary among the softer resilient members 31-31", for example, a softer resilient member 31" closest to pivot point 40 may have a stiffness greater than a softer resilient member 31 closest to guard bar 15. In such a case, softer resilient member 31' may have a stiffness lying in between resilient member 31 and resilient member 31", or may have a stiffness substantially identical to one of the two other softer resilient members 31. One of skill in the art will recognize that such stiffness may be set based on a desired geometry for a particular razor head 2. For example, a resilient member nearest guard bar 15 may provide biasing at 10 g at 0.5 mm displacement. The next cutting element (i.e., a second blade from guard bar 15) may provide biasing at 20 g at 0.5 mm displacement. A third cutting element (as taken from the guard bar 15) may provide biasing at 30 g at 0.5 mm of displacement, a fourth blade as taken from guard bar 15 may be 40 g at 0.5 mm and a fifth blade may be biased at 50 g at 0.5 mm.

In other words, the force may be progressively increased starting from the first blade nearest guard bar 25 having the lowest biasing force to an $n^{th}$ blade (nearest cap) having a highest biasing force, e.g., using a gradient of 10 g at 0.5 mm of displacement.

Depending on a desired shaving experience and geometry, this may also be inverted such that the first blade nearest guard bar 15 is biased with greater force than a blade nearest the cap, for example, decreasing by 10 g gradient per cutting element 25.

According to still further embodiments, a variable spring force may be provided among the first to $n^{th}$ blade, for example, 30 g for the first blade, 20 g for the $2^{nd}$, 10 g for the 3rd, 20 g for the $4^{th}$ and 30 g for the $5^{th}$, all a measured at 0.5 mm displacement. One of skill will recognize that multiple configurations are possible, and all such configurations are intended to fall within the scope of the present disclosure.

Notably, measurements may also be made of a spring constant for each resilient member (30; 31; 32). According to some embodiments, a spring constant (k) for a first resilient member may range between 20-30 gram force/mm and a second constant for a second resilient member may be set such that it ranges between 50-60 gram force/mm.

For example, a stiffer resilient member 30' closest to pivot point 40 may have a stiffness less than a stiffness of a stiffer resilient member 30 nearest the cap 20.

Figure 4A:
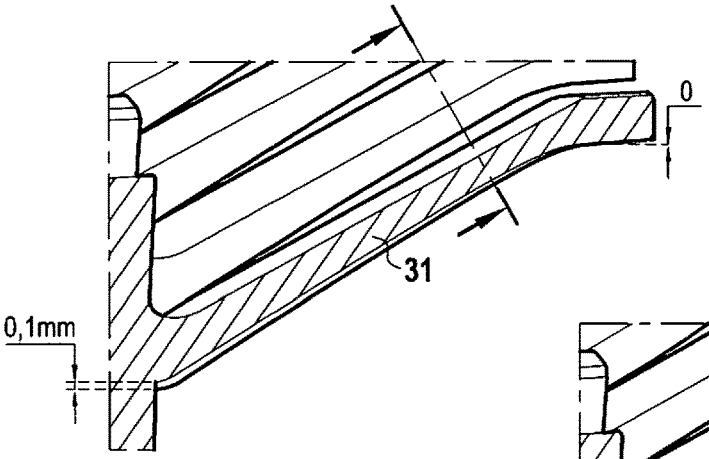
FIGS. 4A-D show exemplary characteristics of resilient members associated with a shaving razor head in order to obtain characteristics described herein.
Figure 4B:
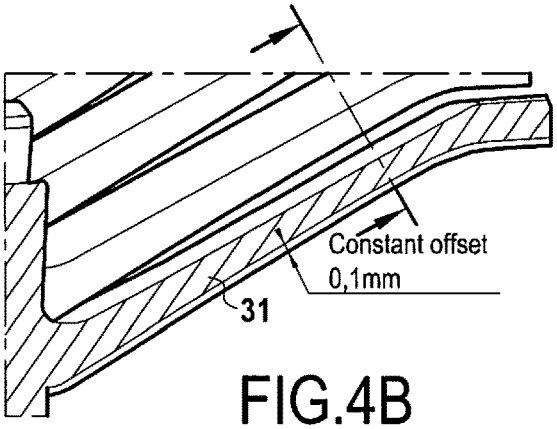
Figure 4C:
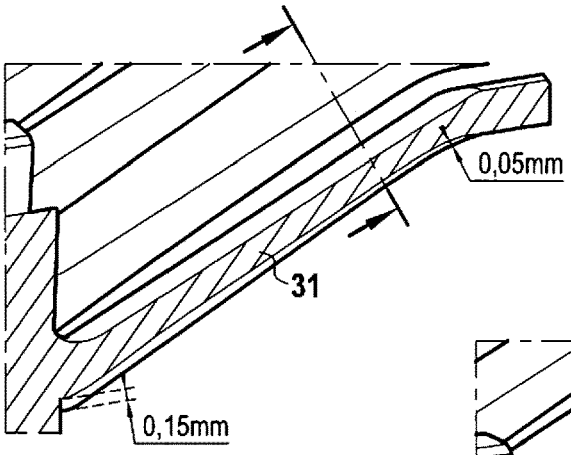
Figure 4D:
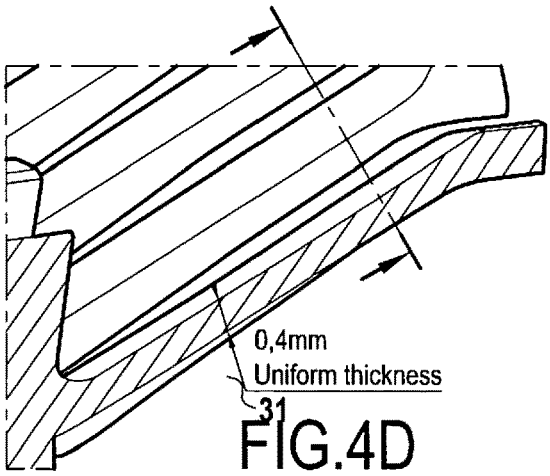

FIG. 4A shows one exemplary thickness modification according to embodiments of the present disclosure. Notably, in FIGS. 4A-4D, lines are provided to show a comparison among the resilient members 30-31, where non-crosshatched portions indicate a lack of material on a softer resilient member 31 as compared to a stiffer resilient member 30, while crosshatched portions indicate presence of material.

As shown, a thickness of softer resilient members 31 may be modified such that proximal end of softer resilient members 31 is thinner (i.e., lacks material), as compared to a stiffer resilient member, while the thickness of the distal end of the softer resilient member 31 remains substantially the same as that of the stiffer resilient member 30. In the present example, the thickness difference at the proximal end is 0.1 mm.

One of skill will recognize that thickness modifications described herein may be performed on a percentage basis to obtain a desired stiffness based on a material used and a desired mold configuration. For example, a thickness of resilient member 31 may be 10 percent, 20 percent, or even 30 percent greater at a proximal end than a thickness at a proximal end of a stiffer resilient member 30.

Alternatively, a first cross sectional area of a softer resilient member 31-31", the cross section being taken along a plane perpendicular to the longitudinal axis of the resilient member and the shaving plane, may vary with respect to the position along the longitudinal axis of the resilient member at which the cross section is taken. Such a variance is specifically decreasing in thickness from a proximal end to a distal end thereof. For example, taking a cross section at a proximal end of a softer resilient member 31 as 100 percent area (e.g., a thickness of the resilient member is substantially identical to the thickness of a stiffer resilient member 30) a cross sectional area midway along a length of the softer resilient member 31 may be 95 percent of the proximal cross sectional area, and at a distal end of the same softer resilient member 31, the cross sectional area may be 80 percent.

The thickness differences between a softer resilient member 31 and a stiffer resilient member 30 may be uniform over the length of the resilient member, or may be non-uniform. In addition, or alternatively, overall geometry of a softer resilient member 31 may be modified to provide for the reduced spring force.

One of skill in the art will recognize that various other methods for modifying the spring force of the resilient elements 30-31 and/or biasing force to which the cutting elements 25 are subjected. For example, material may be added (e.g., in an overmolding process) to stiffen resilient members 30-30'.

According to some embodiments, instead of, or in addition to, modifying a stiffness of resilient members 30, 31, one or more of the plurality of cutting elements 25 may be provided with a greater number of supporting/biasing resilient members, for example, by adding resilient members 32. As shown in FIG. 6, according to such embodiments, the cutting element 25 closest to cap 20 may be supported by a total of four resilient members, two resilient members 30 and two resilient members 32. Resilient members 32 may be positioned along a longitudinal axis of blade 25 at appropriate intervals, so as to provide additional biasing force on blade 25 toward the shaving plane.

Additional resilient members 32 configured, for example, as cantilever springs, may extend from a proximal end at a center support of razor head 2 and a distal end positioned to contact at a contact point, its respective cutting element 25.

For example, when a single additional resilient member 32 is provided, such an additional resilient member 32 may be positioned at a point of symmetry along a longitudinal axis of cutting element 25.

In another example, where two or more additional resilient members are provided, positioning thereof along a longitudinal axis of a cutting element 25 may be configured to balance the overall biasing force across a length of cutting element 25.

By providing additional resilient members 32 to one or more cutting elements 25 (e.g., those cutting elements nearer cap 20), greater biasing force on each cutting elements 25 having the additional resilient members 32 may be achieved. Therefore, resilient members 31, which are intended to have a lower biasing force, may remain unmodified, due to the increased biasing force on the remaining cutting elements 25.

According to still further embodiments, a material removal process may be performed following molding of housing 10, for example, via a computer aided cutting process (e.g., CNC).

According to other embodiments, housing 10 with cap 20 and guard bar 15 may be molded from a first material, in examples with one or more of resilient members 30, while resilient members 31 may be overmolded using, for example, a multi-stage injection molding process, with possibly a different material from that of the housing 10. For example, housing 10, cap 20, guard bar 15 and resilient members 30 (e.g., resilient members between cap 20 and pivot axis L) may be molded in a first injection molding step from a first material having a first modulus of elasticity, (e.g., ABS).

Subsequently, softer resilient members 31 (e.g., resilient members between guard bar 15 and pivot axis L) may be overmolded onto housing 10 from a second material having a second modulus of elasticity less than that of the first modulus of elasticity, e.g., ABS with a lower modulus (i.e., a different grade of ABS), ABS modified with an elastomer to increase softness, and/or a compatible material to ABS having a lower modulus, for example HIPS or MBS or MABS.

According to another example, the housing 10, cap 20, and guard bar 15 may be unitarily formed with resilient members 31 (e.g., resilient members between guard bar 15 and pivot axis L). For example, housing 10, cap 20, guard bar 15 and resilient members 31 (e.g., resilient members between guard bar 15 and pivot axis L) may be molded in a first injection molding step from a first material having the second modulus of elasticity, for example, ABS with a lower modulus (i.e., a different grade of ABS), ABS modified with an elastomer to increase softness, and/or a compatible material to ABS having a lower modulus, for example HIPS or MBS or MABS. Subsequently, resilient members 30 (e.g., resilient members between cap 20 and pivot axis L) may be overmolded onto housing 10 from a second material having the first modulus of elasticity greater than that of the first modulus of elasticity for example ABS.

Of course, as an alternative, or in addition to an overmolding, an assembly of first and second parts, where the first part forms softer resilient members (31) and the second part forms harder resilient members (30) may be performed. Such an assembly may be performed using an adhesive, a reheating of the parts (e.g., to fuse via melting), etc.

One of skill will recognize that none of the plurality of resilient members may be molded unitarily with the housing 10, and that two or more subsequent molding steps may be undertaken using two different materials to obtain the desired resilient members 30 and 31 having the desired stiffness differences.

Any such variation configured to modify a spring force of one or more of the resilient members 30-31 is intended to fall within the scope of the appended claims.

Throughout the description, including the claims, the term "comprising a" should be understood as being synonymous with "comprising at least one" unless otherwise stated. In addition, any range in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

Even though some features, concepts or aspects of the disclosed concept may be described herein as being a preferred (more or less) arrangement or method, such description is not intended to suggest that such feature is required or necessary unless expressly so stated.

It is intended that the specification and examples be considered as exemplary only, with a true scope of the disclosure being indicated by the following claims.

The invention claimed is:

1. A razor head for shaving, comprising:

a housing comprising:

a plurality of blades movably mounted within the housing; and a plurality of resilient members, wherein:

at least one of the resilient members comprises a material different than that of another of the resilient members:

each blade of the plurality of blades is biased toward a shaving plane, at least in part, by at least one of the plurality of resilient members, and wherein one or more blades of the plurality of blades is biased toward the shaving plane with a first force that is greater than a second force biasing another blade of the plurality of blades toward the shaving plane;

wherein the plurality of blades includes a first blade and a second blade, wherein the plurality of resilient members includes a first resilient member, a second resilient member, and a third resilient member, and wherein the first blade is supported by a greater number of resilient members among the plurality of resilient members than the second blade such that the first blade is supported by the first resilient member, the second resilient, and the third resilient member, wherein the first resilient member is provided at a first end of the first blade, the second resilient member is provided at a second end of the first blade opposite to the first end, and the third resilient member is provided at a central portion of the first blade between and spaced apart from the first resilient member and the second resilient member.

2. The razor head according to claim 1, wherein one or more of the plurality of resilient members has a stiffness different than that of another one of the plurality of resilient members.

3. The razor head according to claim 1, wherein the plurality of resilient members includes a first resilient member and a second resilient member, wherein a first stiffness of the first resilient member located nearest a guard bar of the razor head is lower than a second stiffness of the second resilient member located nearest to a cap of the razor head.

4. The razor head according to claim 3, wherein the plurality of resilient members includes a third resilient member, wherein the third resilient member is positioned between the first resilient member and the second resilient member and has a third stiffness which is different as compared to the first stiffness and the second stiffness.

5. The razor head according to claim 1, wherein the plurality of resilient members includes a first resilient member and a second resilient member, wherein a first stiffness of the first resilient member located nearest a guard bar of the razor head is higher than a second stiffness of the second resilient member located nearest to a cap of the razor head.

6. The razor head according to claim 1, wherein the plurality of blades comprises at least two blades.

7. The razor head according to claim 1, further comprising a guard bar, a cap, and a handle connection area, wherein the handle connection area is configured to attach to a handle, wherein an arrangement of the plurality of resilient members is based on a position of the handle connection area such that each of the plurality of resilient members located between the guard bar and the handle connection area has a stiffness lower than a stiffness of each of the plurality of resilient members positioned between the handle connection area and the cap.

8. The razor head according to claim 1, wherein each resilient member of the plurality of comprises a cantilevered spring having a proximal end and a distal end, the distal end maintaining contact with its corresponding blade to cause the biasing.

9. The razor head according to claim 1, wherein:

the plurality of resilient members includes a first resilient member and a second resilient member, a first stiffness for the first resilient member is set such that a spring force for the first resilient member ranges between 10-15 grams at 0.5 mm of displacement from a free, unstressed position of a distant end of the first resilient member, and a second stiffness for the second resilient member is set such that a spring force for the second resilient member ranges between 25-35 grams at 0.5 mm of displacement from a free, unstressed position of a distal end of the second resilient member.

10. The razor head according to claim 9, wherein a modulus of elasticity of a material comprising each of the resilient members ranges between 1500 and 3000 MPa.

11. The razor head according to claim 1, wherein the housing includes a cap and a guard bar, and the plurality of resilient members, the cap, and the guard bar are unitarily molded.

12. The razor head according to claim 1, wherein the plurality of resilient members includes a first resilient member and a second resilient member, wherein a first cross sectional area of the first resilient member taken along a plane perpendicular to a longitudinal axis of the razor head and the shaving plane, differs from a second cross sectional area of the second resilient member taken along the same plane.

13. The razor head according to claim 12, wherein the second resilient member has a greater thickness at its proximal end than the first resilient member at its proximal end.

14. The razor head according to claim 12, wherein the second resilient member has a greater thickness along its entire length than the first resilient member at any point along its length.

15. The razor head according to claim 12, wherein a difference between a thickness of the first resilient member and the second resilient member at any common point along a longitudinal axis thereof, is between 10 and 50 percent.

16. The razor head according to claim 1, wherein the plurality of resilient members includes a first resilient member, wherein a first cross sectional area of the first resilient member taken along a plane perpendicular to a longitudinal axis of the razor head and the shaving plane varies along the longitudinal axis.

17. The razor head according to claim 1, wherein the housing and the resilient members are formed via a multi-stage injection molding process.

18. The razor head according to claim 1, wherein the plurality of resilient members includes a first resilient member, wherein a first cross sectional area of the first resilient member taken along a plane perpendicular to a longitudinal axis of the razor head and the shaving plane decreases in an area along the longitudinal axis from a proximal end to a distal end thereof.

19. A razor head for shaving, comprising:

a housing comprising:

a plurality of blades movably mounted within the housing by a plurality of cantilever springs, wherein the plurality of blades includes a first blade and a second blade, wherein:

each of the plurality of blades is biased toward a shaving plane, at least in part, by at least one of the plurality of cantilever springs, at least one of the plurality of cantilever springs is made as a softer spring than the others of the plurality of cantilever springs and/or at least one of the plurality of cantilever springs is made stiffer than the others of the plurality of cantilever springs such that the first blade is biased towards the shaving plane with a first force that is greater than a second force biasing the second blade toward the shaving plane, and the first blade is supported by more cantilever springs, among the plurality of cantilever springs, than the second blade such that the plurality of cantilever springs includes a first cantilever spring provided at a first end of the first blade, a second cantilever spring provided at a second end of the first blade opposite the first end, and a third cantilever spring provided at a central portion of the first blade between the first cantilever spring and the second cantilever spring.

* * * * *